US007313243B2

(12) United States Patent
Hsu

(10) Patent No.: US 7,313,243 B2
(45) Date of Patent: Dec. 25, 2007

(54) SOUND PICKUP METHOD AND SYSTEM WITH SOUND SOURCE TRACKING

(75) Inventor: Tien-Ming Hsu, Taipei Hsien (TW)

(73) Assignee: Acer Inc., Taipei Hsien (TW)

( * ) Notice: Subject to any disclaimer, the term of this patent is extended or adjusted under 35 U.S.C. 154(b) by 803 days.

(21) Appl. No.: 10/781,817

(22) Filed: Feb. 20, 2004

(65) Prior Publication Data

US 2005/0111674 A1 May 26, 2005

(30) Foreign Application Priority Data

Nov. 20, 2003 (TW) ..... 92132578 A

(51) Int. Cl.
*H04R 3/00* (2006.01)

(52) U.S. Cl. ..... 381/92; 381/122; 381/91; 348/14.01; 348/14.08

(58) Field of Classification Search ..... 381/92, 381/61, 122, 91; 348/14.01, 14.08
See application file for complete search history.

(56) References Cited

U.S. PATENT DOCUMENTS 5,940,118 A * 8/1999 Van Schyndel ..... 348/14.05
6,469,732 B1 * 10/2002 Chang et al. ..... 348/14.08
6,593,956 B1 * 7/2003 Potts et al. ..... 348/14.09
6,826,284 B1 * 11/2004 Benesty et al. ..... 381/92

* cited by examiner

*Primary Examiner*—Vivian Chin
*Assistant Examiner*—Con P. Tran
(74) *Attorney, Agent, or Firm*—Merchant & Gould P.C.

(57) ABSTRACT

A sound pickup system includes a sound source tracking device that is operable to obtain distance and direction values of a target sound source relative to the sound source tracking device, and that determines nearest and farthest ones of a plurality of microphones in a microphone array relative to the target sound source with reference to determined distances of the sound source tracking device from the microphones, and the distance and direction values obtained by the sound source tracking device. A signal processing unit includes a delay calculator for determining appropriate time delays for the microphones with reference to information from the sound source tracking device, and a delay processor for processing signals generated by the microphones in the microphone array by introducing the corresponding time delays determined by the delay calculator into the signals from the microphones.

9 Claims, 3 Drawing Sheets

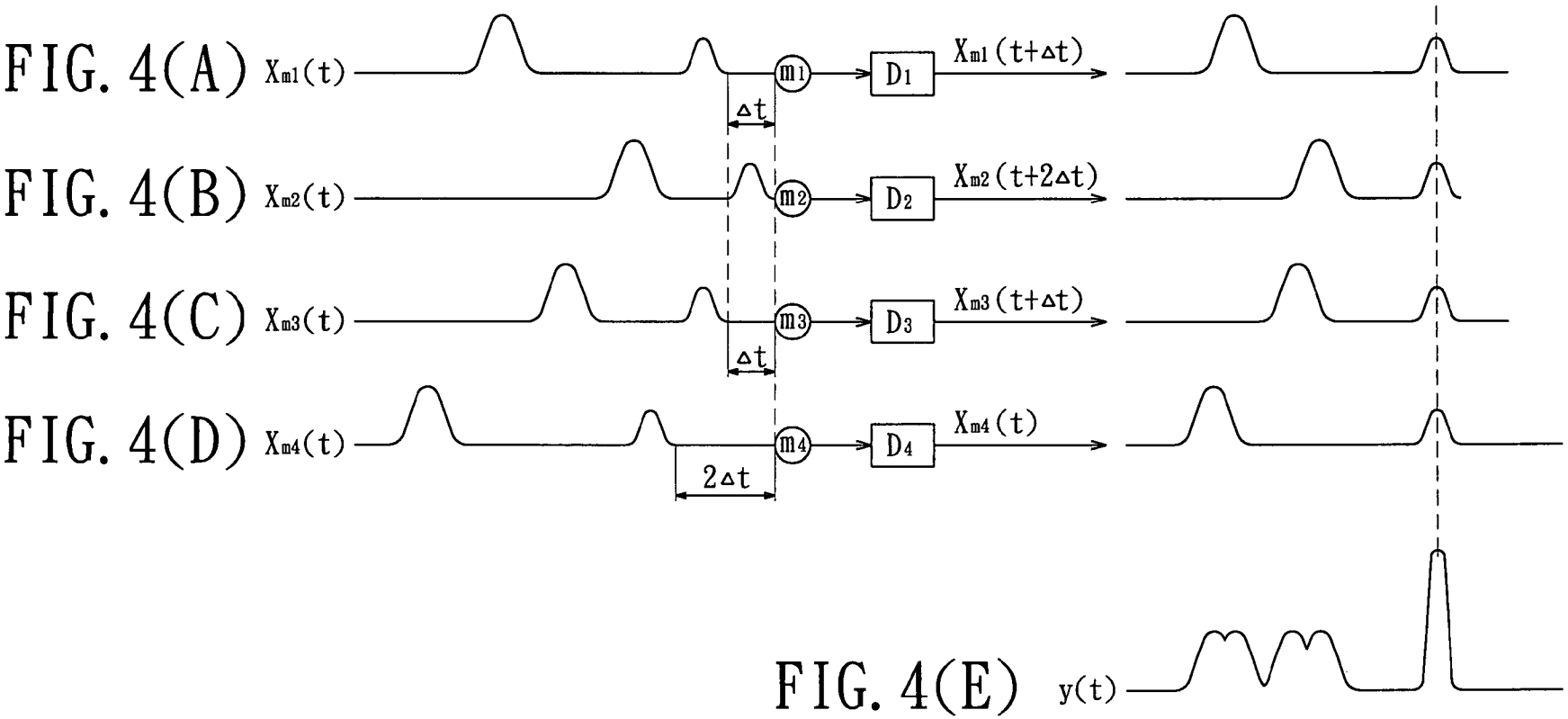
FIG. 4(A) $X_{m1}(t)$
FIG. 4(B) $X_{m2}(t)$
FIG. 4(C) $X_{m3}(t)$
FIG. 4(D) $X_{m4}(t)$
FIG. 4(E) $y(t)$

SOUND PICKUP METHOD AND SYSTEM WITH SOUND SOURCE TRACKING

CROSS-REFERENCE TO RELATED APPLICATION

This application claims priority of Taiwanese application no. 092132578, filed on Nov. 20, 2003.

BACKGROUND OF THE INVENTION

1. Field of the Invention

The invention relates to a sound pickup method and system, more particularly to a sound pickup method and system that employs sound source tracking to enhance sound pickup quality of a microphone array.

2. Description of the Related Art

A conventional microphone array includes a plurality of microphones disposed in an array and spaced apart from each other. By processing sound source signals picked up by the microphones, directionality of the sound source signals can be determined. As such, the microphone array can be used to promote signal-to-noise ratio (abbreviated as SNR) so as to enhance a target signal that originates from a specific direction by suppressing noise from other directions.

Referring to FIG. 1, a conventional so-called delay-and-sum microphone array 1 is shown to include a number (n) of microphones 11 disposed in an array, a number (n) of delay units 12, each of which is coupled to a corresponding microphone 11, and an adder 13 connected to the delay units 12. Adjacent ones of the microphones 11 are spaced apart by a distance (d). When each of the microphones 11 receives a sound source signal, the corresponding delay unit 12 will perform corresponding signal delay for the sound source signal in accordance with predetermined estimated delay times, such as Δt1, Δt2 and Δt3, in sequence. For example, the signal received by the first microphone (m1) will be transmitted to the adder 13 after a delay time (n−1)×Δt1, the signal received by the second microphone (m2) will be transmitted to the adder 13 after a delay time (n−2)×Δt1, and so on. The delayed signals will be subsequently combined in the adder 13. Hence, for the predetermined estimated delay times Δt1, Δt2, and Δt3, the combined signal can be expressed as one of:

$$y1(t) = \sum_{k=1}^{n} x_k(t + (k-1) \times \Delta t1),$$

$$y2(t) = \sum_{k=1}^{n} x_k(t + (k-1) \times \Delta t2), \text{ and}$$

$$y3(t) = \sum_{k=1}^{n} x_k(t + (k-1) \times \Delta t3),$$

Then, from the combined signals y1 (t), y2 (t) and y3 (t), a signal having the largest amplitude is determined so as to obtain an indication of the loudest sound source. As such, a delay time At defined as the time difference between the time when the signal of the loudest sound source reaches a microphone nearest thereto and the time when the signal of the loudest sound source reaches another microphone adjacent to the nearest microphone is obtained. By the formula: $d \times \sin\theta = v \times \Delta t$, where v is the velocity of sound, the direction and the angle θ of the loudest sound source can be calculated. After the delay time Δt is obtained, the delay units 12 are operated to delay the sound source signals of the corresponding microphones 11 in accordance with the delay time Δt. In this manner, signals from the loudest sound source are enhanced while suppressing signals from sound sources in other directions.

From the foregoing, it is apparent that the conventional microphone array 1 is able to find the direction of a loudest sound source and to enhance signals picked up from the loudest sound source. However, in situations where the noise amplitude is greater than that of a target sound source signal (i.e., the loudest sound source is not the target sound source), the undesired noise signal will be enhanced while suppressing the target sound source signal, thereby resulting in poor sound pickup quality.

SUMMARY OF THE INVENTION

Therefore, the object of the present invention is to provide a sound pickup method and system that employs sound source tracking to overcome the aforesaid drawbacks commonly associated with the prior art.

According to one aspect of the present invention, a sound pickup method is to be implemented using a microphone array that includes a plurality of microphones disposed in an array and spaced apart from each other, and a sound source tracking device that is disposed at determined distances relative to the microphones in the microphone array. The sound pickup method comprises:

a) operating the sound source tracking device to obtain distance and direction values of a target sound source relative to the sound source tracking device;

b) with reference to the determined distances of the sound source tracking device from the microphones in the microphone array, and the distance and direction values obtained in step a), determining nearest and farthest ones of the microphones in the microphone array relative to the target sound source;

c) determining appropriate time delays for the nearest one of the microphones according to the distance thereof from the farthest one of the microphones and for other ones of the microphones in the microphone array according to the distance of each of the other ones of the microphones from the nearest one of the microphones; and d) processing signals generated by the microphones in the microphone array by introducing the corresponding time delays determined in step c) into the signals from the microphones.

According to another aspect of the present invention, a sound pickup system comprises a microphone array, a sound source tracking device, and a signal processing unit. The microphone array includes a plurality of microphones disposed in an array and spaced apart from each other. The sound source tracking device is disposed at determined distances relative to the microphones in the microphone array, and is operable so as to obtain distance and direction values of a target sound source relative to the sound source tracking device. The sound source tracking device determines nearest and farthest ones of the microphones in the microphone array relative to the target sound source with reference to the determined distances of the sound source tracking device from the microphones in the microphone array, and the distance and direction values obtained by the sound source tracking device. The signal processing unit is coupled to the microphone array and the sound source tracking device, and includes a delay calculator for determining appropriate time delays for the nearest one of the microphones according to the distance thereof from the farthest one of the microphones and for other ones of the microphones in the microphone array according to the distance of each of the other ones of the microphones from the nearest one of the microphones. The signal processing unit further includes a delay processor for processing signals generated by the microphones in the microphone array by introducing the corresponding time delays determined by the delay calculator into the signals from the microphones.

BRIEF DESCRIPTION OF THE DRAWINGS

Other features and advantages of the present invention will become apparent in the following detailed description of the preferred embodiment with reference to the accompanying drawings, of which:

FIGS. 4(A) to 4(E) are exemplary time graphs to illustrate how sound signals picked by microphones of a microphone array are processed in accordance with the preferred embodiment of this invention.

DETAILED DESCRIPTION OF THE PREFERRED EMBODIMENT

Figure 1:
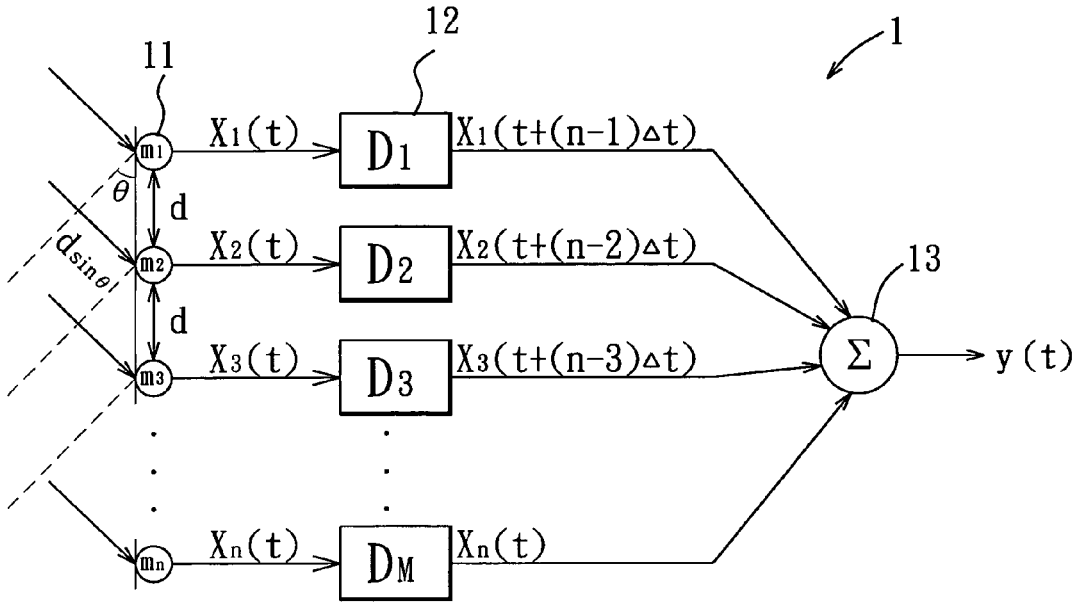
FIG. 1 PRIOR ART
FIG. 1 illustrates a conventional sound pickup system that incorporates a microphone array.
Figure 2:
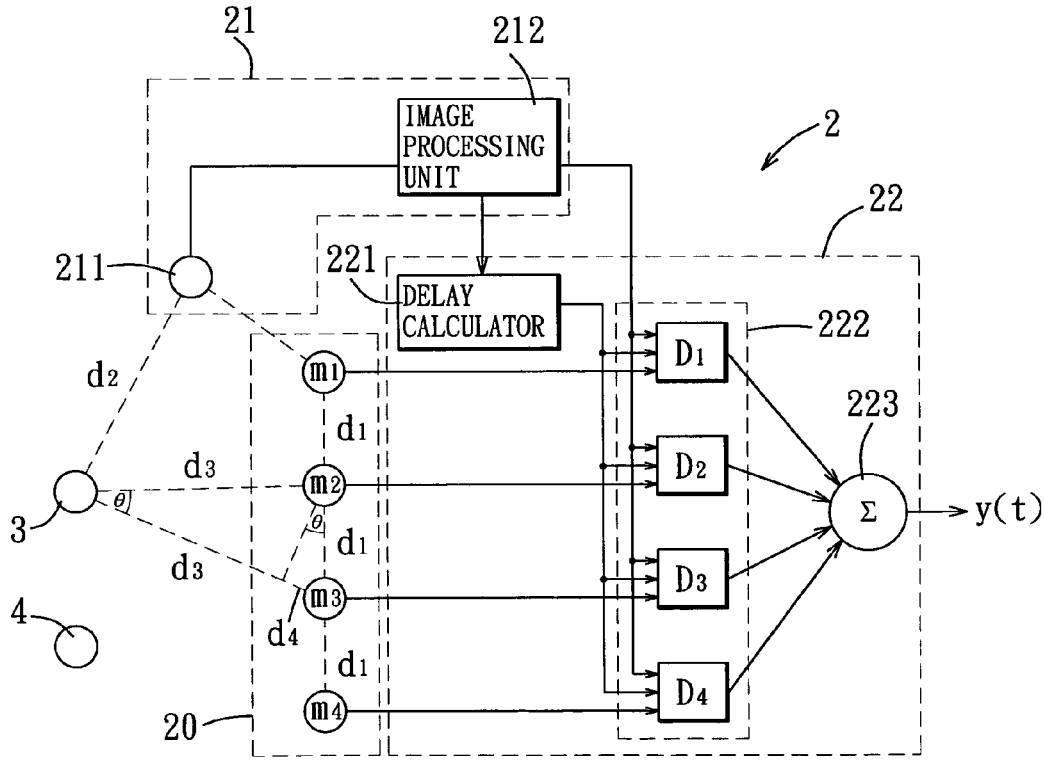
FIG. 2 is a block diagram illustrating the preferred embodiment of a sound pickup system according to the present invention.

Referring to FIG. 2, the preferred embodiment of a sound pickup system 2 according to the present invention is shown to include a microphone array 20, a sound source tracking device 21, and a signal processing unit 22.

The microphone array 20 includes a plurality of microphones disposed in an array and spaced apart from each other. In this embodiment, the microphone array 20 includes four microphones (m1), (m2), (m3), (m4) that are disposed in a one-dimensional array. Adjacent ones of the microphones (m1), (m2), (m3), (m4) are spaced apart from each other by a constant distance (d1).

The sound source tracking device 21 is disposed at determined distances relative to the microphones (m1), (m2), (m3), (m4) in the microphone array 20, and is operable so as to obtain distance and direction values of a target sound source 3 relative to the sound source tracking device 21. In this embodiment, the sound source tracking device 21 includes an image capturing device 211, such as a digital camera, and an image processing unit 212 coupled to the image capturing device 211. The image processing unit 212 determines the distance and direction values from size and position of an image of a body part of the target sound source 3 captured by the image capturing device 211. In this embodiment, the body part is a human face, and the image processing unit 212 thus includes a known human face recognition module. Accordingly, even when a person (i.e., the desired target sound source 3) and an animal 4 simultaneously fall within an image capturing range of the image capturing device 211, the image processing unit 212 is still able to determine the required distance and direction values for the target sound source 3.

Moreover, the image processing unit 212 further determines nearest and farthest ones of the microphones (in this example, m2 and m4) in the microphone array 20 relative to the target sound source 3 with reference to the determined distances of the sound source tracking device 21 from the microphones (m1), (m2), (m3), (m4) in the microphone array 20, and the distance and direction values obtained by the image processing unit 212.

It should be noted herein that implementation of the sound source tracking device 21 should not be limited to that described hereinabove. Other alternatives, such as the so-called "Cricket" Indoor Locating System, a wireless network indoor locating system, and a global satellite positioning system, are available for realizing the aforesaid functions of the sound source tracking device 21.

The signal processing unit 22 is coupled to the microphone array 20 and the sound source tracking device 21, and includes a delay calculator 221, a delay processor 222, and an adder 223.

The delay calculator 221 determines appropriate time delays for the nearest one of the microphones (in this example, m2) according to the distance thereof from the farthest one of the microphones (in this example, m4) and for other ones of the microphones (in this example, m1 and m3) in the microphone array 20 according to the distance of each of the other ones of the microphones (in this example, m1 and m3) from the nearest one of the microphones (in this example, m2).

In this embodiment, the delay processor 222 includes four delay components (D1), (D2), (D3), (D4) for processing signals generated by the microphones (m1), (m2), (m3), (m4) in the microphone array 20 by introducing the corresponding time delays determined by the delay calculator 221 into the signals from the microphones (m1), (m2), (m3), (m4), respectively.

The adder 223 is coupled to the delay components (D1), (D2), (D3), (D4), and serves to combine the signals processed by the latter.

Figure 3:
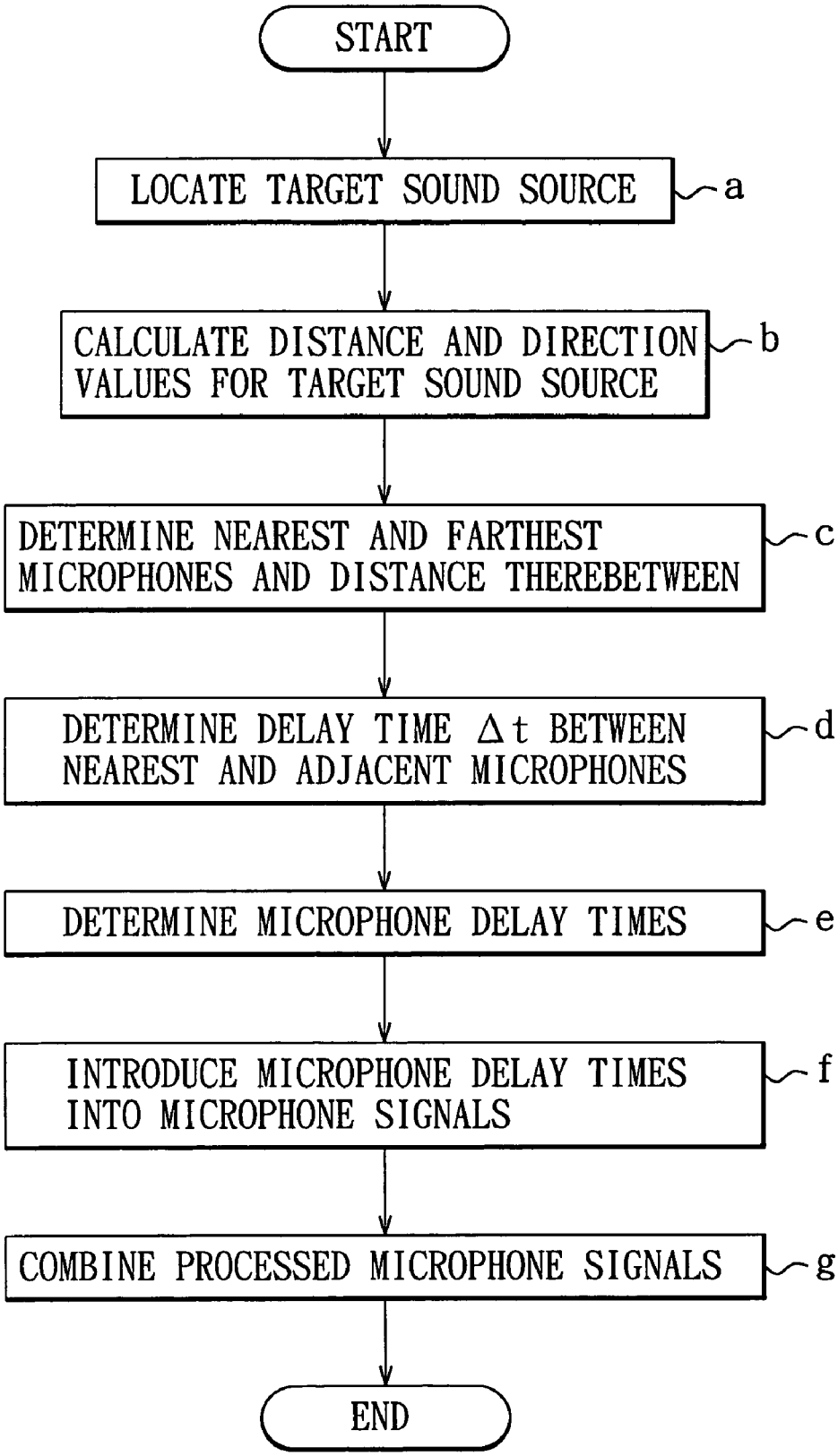
FIG. 3 is a flow chart to illustrate the sound pickup method of the preferred embodiment.

FIG. 3 is a flow chart to illustrate the sound pickup method performed using the sound pickup system 2 of the preferred embodiment.

In step a), the sound source tracking device 21 is operated to locate the target sound source 3 through the image capturing device 211 and the image processing unit 212.

In step b), the image processing unit 212 of the sound source tracking device 21 calculates a distance value (d2) and a direction value of the target sound source 3 relative to the sound source tracking device 21.

In step c), with reference to the determined distances of the sound source tracking device 21 from the microphones (m1), (m2), (m3), (m4) in the microphone array 20, and the distance value (d2) and the direction value obtained in step b), the image processing unit 212 determines nearest and farthest ones of the microphones (i.e., m2 and m4, respectively) in the microphone array 20 relative to the target sound source 3, as well as the distance (d3) between the nearest microphone (m2) and the target sound source 3, and the distance (i.e., 2×d1) between the nearest and farthest microphones (m2 and m4).

In step d), a delay time $\Delta t$ defined as the time difference between the time when the sound source signal reaches the nearest microphone (m2) and the time when the sound source signal reaches another microphone (e.g. m3) adjacent to the nearest microphone (m2) is determined according to the formula: $d4=d1\times\sin\theta=v\times\Delta t$, where d4 is the difference between the distance of the target sound source 3 to the adjacent microphone (m3) and the distance (d3) of the target sound source 3 to the nearest microphone (m2), $\theta$ is the angle formed by a first line radiating from the target sound source 3 to the nearest microphone (m2) and a second line radiating from the target sound source 3 to the adjacent microphone (m3) and v is the velocity of sound.

In step e), the delay calculator 221 determines appropriate time delays for the nearest microphone (m2) according to the distance thereof from the farthest microphone (m4) and for other ones of the microphones (i.e., m1 and m3) in the microphone array 20 according to the distance of each of the other ones of the microphones (i.e., m1 and m3) from the nearest microphone (m2) by inference as follows:

1. Signals picked up by the farthest microphone (m4) need not be delayed.

2. Signals picked up by the nearest microphone (m2) will be delayed by a multiple (s) of the delay time Δt, the multiple (s) being the number of microphone intervals between the nearest and farthest microphones (m2 and m4), which is equal to 2 in this example.

3. Signals picked up by the other microphones (i.e., m1 and m3) will be delayed by a factor (i) of the delay time Δt, the factor (i) being equal to the difference between the multiple (s) and the number of microphone intervals (in this case, 1) between the microphone (m1 or m3) and the nearest microphone (m2).

Then, in step f), the delay calculator 221 provides the microphone delay times calculated thereby to the delay processor 221. The delay components (D1), (D2), (D3), (D4) of the delay processor 222 process the signals generated by the microphones (m1), (m2), (m3), (m4) in the microphone array 20 by introducing the corresponding time delays determined in step e) into the signals from the microphones (m1), (m2), (m3), (m). As best shown in FIGS. 4 (A) to 4 (D), the signals $X_{m1}$ (t), $X_{m2}$ (t), $X_{m3}$ (t) and $X_{m4}$(t) picked up by the microphones (m1), (m2), (m3), (m4) respectively become $X_{m1}(t+\Delta t)$, $X_{m2}(t+2\Delta t)$, $X_{m3}(t+\Delta t)$ and $X_{m4}(t)$ after processing by the delay processor 222.

Finally, in step g), the adder 223 combines the microphone signals processed by the delay components (D1), (D2), (D3), (D4) of the delay processor 222 to result in an output signal y(t) in which the target sound source signal is enhanced, as best shown in FIG. 4 (E).

In sum, as compared with the aforesaid prior art, which enhances signals picked up from a loudest sound source that is not necessarily the target sound source, the sound pickup method and system of this invention employs sound source tracking techniques such that delay processing of signals picked up by microphones in a microphone array is performed according to the detected location of a target sound source in order to optimize the sound pickup quality.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A sound pickup method to be implemented using a microphone array that includes a plurality of microphones disposed in an array and spaced apart from each other, and a sound source tracking device tat is disposed at determined distances relative to the microphones in the microphone array, said sound pickup method comprising:

a) operating the sound source tracking device to obtain distance and direction values of a target sound source relative to the sound source tracking device;

b) with reference to the determined distances of the sound source tracking device from the microphones in the microphone array, and the distance and direction values obtained in step a), determining nearest and farthest ones of the microphones in the microphone array relative to the target sound source;

c) determining appropriate time delays for the nearest one of the microphones according to the distance thereof from the farthest one of the microphones and for other ones of the microphones in the microphone array according to the distance of each of said other ones of the microphones from the nearest one of the microphones; and d) processing signals generated by the microphones in the microphone array by introducing the corresponding time delays determined in step c) into the signals from the microphones.

2. The sound pickup method as claimed in claim 1, farther comprising:

e) combining the signals processed in step d).

3. The sound pickup method as claimed in claim 1, wherein, in step a), the distance and direction values are determined from size and position of an image of a body part of the target sound source captured by the sound source tracking device.

4. The sound pickup method as claimed in claim 3, wherein the body part is a human face.

5. A sound pickup system comprising:

a microphone array that includes a plurality of microphones disposed in an array and spaced apart from each other;

a sound source tacking device that is disposed at determined distances relative to said microphones in said microphone array, and that operates so as to obtain distance and direction values of a target sound source relative to said sound source tracking device, said sound source tracking device determining nearest and farthest ones of said microphones in said microphone array relative to the target sound source with reference to the determined distances of said sound source tracking device from said microphones in said microphone array, and the distance and direction values obtained by said sound source tracking device; and a signal processing unit coupled to said microphone array and said sound source tracking device, said signal processing unit including a delay calculator for determining appropriate time delays for the nearest one of said microphones according to the distance thereof from the farthest one of said microphones and for other ones of said microphones in said microphone array according to the distance of each of said other ones of said microphones from the nearest one of said microphones, said signal processing unit further including a delay processor for processing signals generated by said microphones in said microphone array by introducing the corresponding time delays determined by said delay calculator into the signals from said microphones.

6. The sound pickup system as claimed in claim 5, wherein said signal processing unit further includes an adder for combining the signals processed by said delay processor.

7. The sound pickup system as claimed in claim 5, wherein said sound source tracking device includes an image capturing device and an image processing unit coupled to said image capturing device, said image processing unit determining the distance and direction values from size and position of an image of a body part of the target sound source captured by said image capturing device.

8. The sound pickup system as claimed in claim 7, wherein the body part is a human face.

9. The sound pickup system as claimed in claim 5, wherein said sound source tracking device includes one of an indoor locating system, a wireless network indoor locating system, and a global satellite positioning system.

* * * * *